United States Patent [19]

Yaeger

[11] 4,273,338

[45] Jun. 16, 1981

[54] GAME APPARATUS WITH NOTCHED GAME BOARD

[76] Inventor: Michael Yaeger, P.O. Box 4304, Pioneer Square Station, Seattle, Wash. 98104

[21] Appl. No.: 33,135

[22] Filed: Apr. 25, 1979

[51] Int. Cl.[3] ..... A63F 3/00

[52] U.S. Cl. ..... 273/282; 273/148 A; 273/303

[58] Field of Search ..... 273/236, 292, 309, 303, 273/282

[56] References Cited

U.S. PATENT DOCUMENTS

| | | | |
|---|---|---|---|
| 1,825,673 | 10/1931 | Latimer | 273/292 |
| 2,180,873 | 11/1939 | Hill | 273/309 |
| 4,003,577 | 1/1977 | Bolach | 273/243 |

FOREIGN PATENT DOCUMENTS

| | | | |
|---|---|---|---|
| 16401 | of 1909 | United Kingdom | 273/309 |
| 380417 | 9/1932 | United Kingdom | 273/309 |

*Primary Examiner*—Richard C. Pinkham
*Assistant Examiner*—Carl Moy
*Attorney, Agent, or Firm*—Christensen, O'Connor, Johnson & Kindness

[57] ABSTRACT

A game apparatus includes a board and a set of blocks. The blocks are divided into four groups with an equal number of blocks in each group. Each block has upon it some marking that identifies to which of the groups it belongs. Also, each block has indicia thereon that designates its priority within the group. The board has a central portion that is divided into a plurality of spaces, there being one space on the board for each block of the set. The board further has notches formed along its edge to hold the blocks of each player during the course of the game.

9 Claims, 5 Drawing Figures

Fig. 1.
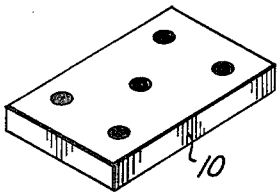
Fig. 4.
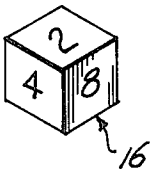
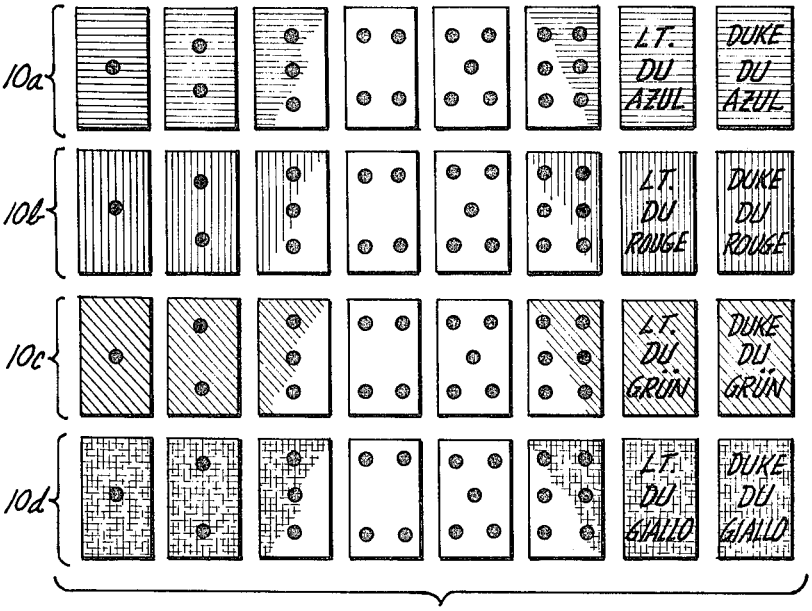
Fig. 2.
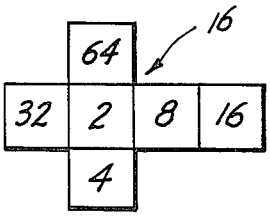
Fig. 5.
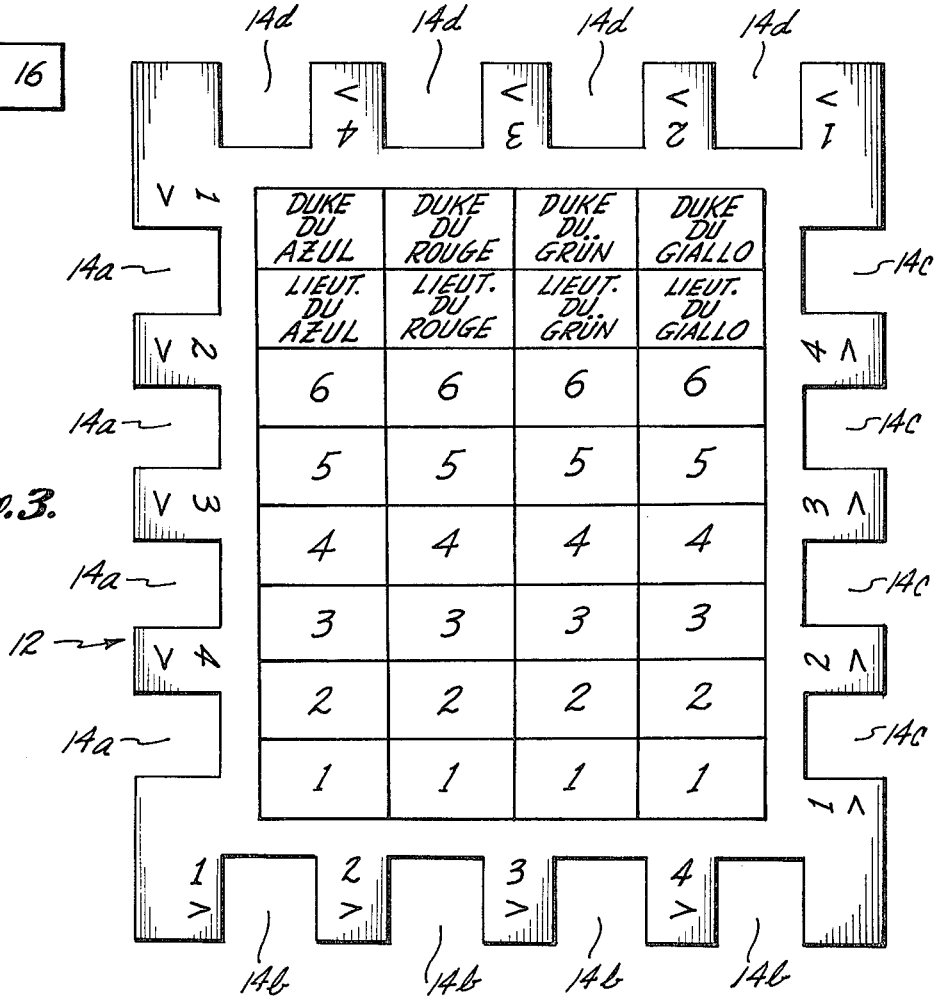
Fig. 3.

GAME APPARATUS WITH NOTCHED GAME BOARD

BACKGROUND OF THE INVENTION

The present invention relates to game apparatus and an object of the invention is to provide simple apparatus by which an amusing and novel game can be played by persons of all ages.

A further object of the invention is to provide game apparatus that is attractive in appearance and that can be manufactured and sold at low cost.

SUMMARY OF THE PRESENT INVENTION

According to the present invention, there is provided in combination, a board and set of blocks, the blocks being divided into four groups, each group having an equal number of blocks therein. Each block carries upon it some marking that indicates to which of the four groups it belongs. Each block also carries upon it an indication of its priority within its group.

The board is divided into a number of spaces, there being one space on the board for each block of the set. The board further has notches formed in its outer perimeter to hold the blocks used by each player during playing of the game.

In a further embodiment, the game apparatus includes a point multiplier piece having indicia thereon indicating multiples of point values. The piece is operated by a player so as to expose a desired one of the indicia to alert the opposing players that the point values of the blocks being played are to be multiplied by the multiple indicated by the multiplier piece.

BRIEF DESCRIPTION OF THE DRAWINGS

In order that the invention may be more readily understood, a sample game according to the invention and one set of rules for playing such game will now be described by way of example with reference to the accompanying drawings:

FIG. 1 is a perspective view of a typical block made in accordance with the principles of the present invention;

FIG. 2 is a plan view of a set of blocks for use in the invention;

FIG. 3 is a plan view of a game board for use with the set of blocks shown in FIG. 2;

FIG. 4 is a perspective view of a point multiplier piece for use in the invention;

FIG. 5 is a development of the point multiplier piece of FIG. 4 on a flat surface,

DETAILED DESCRIPTION OF THE PREFERRED EMBODIMENT

The Equipment

The game of the present invention preferably utilizes a set of blocks 10, a typical block being illustrated in FIG. 1. While a rectangular block is described and illustrated, it will be apparent to those of ordinary skill in the art that the shape of the block is not critical to the present invention and a block of any shape can be used. FIG. 2 illustrates a set of 32 blocks in accordance with one embodiment of the invention. The 32 blocks are divided into four groups of blocks 10*a*, 10*b*, 10*c* and 10*d*. The blocks in each group are marked to indicate the priority from 1 to 8 of each block in each group. The blocks can be marked in any suitable manner. In the preferred embodiment illustrated, the first six blocks have dots (from one to six) placed on one face of the block to indicate its ranking from one to six. The seventh and eighth blocks could likewise have dots thereon, however, in the preferred embodiment, the blocks are marked with fanciful designations. In the illustrated embodiment, the game is given a noble flavor by designating the seventh blocks as lieutenants and the eighth and highest priority blocks as dukes.

The blocks of each group are similarly marked so as to distinguish them from the blocks of any other group. Preferably, marking is by means of color, the blocks 10*a* being blue, the blocks 10*b* being red, the blocks 10*c* being green and the blocks 10*d* being yellow. In keeping with this scheme, the lieutenant and duke blocks of each set are named so as to correspond to the color of the block, for example, the highest priority block in the group 10*a* is designated as the Duke Du Azul, Azul being Spanish for blue. Similarly, the other priority blocks are marked as the Duke Du Rouge, Rouge being French for red, the Duke Du Grun, Grun being German for green and the Duke Du Giallo, Giallo being yellow in Italian. The group and priority markings are placed on only one face of the blocks so that when the blocks are placed marked face down it is impossible to distinguish one block from another. The markings described give the blocks and game a flavor of international nobility and political intrigue and are meant to make the game more interesting for the players. The blocks could be marked by some other means than color and the high priority blocks could be designated simply by the numbers 7 and 8 or as colonels and generals, rather than being called lieutenants and dukes, as desired.

A board 12 suitable for use with the blocks 10*a, b, c, d* of FIG. 2 is shown in FIG. 3. The board 12 is substantially square and has a series of four notches 14*a*, 14*b*, 14*c*, 14*d* respectively formed in each of the four edges of the board. The notches are of a size sufficient to accept the blocks and in operation, each of the players sits along a different edge of the board and places the blocks and which he is playing in the notches, as will be better understood from the description of the rules of the game below.

The center of the board 12 is divided into a 4 by 8 grid, each square in the grid bearing an indicator corresponding to one of the blocks 10*a*, 10*b*, 10*c*, or 10*d*. During the play of the game, the blocks are placed on the corresponding squares, as will be seen from the discussion of the rules below.

OBJECT OF THE GAME

The object of the game is to score points, points being scored by collecting any of the 32 blocks, each of the blocks being assigned a specific point value. The winner of the game may be declared the player having the most points after the play of an agreed number of games or alternatively it may be the player who has first scored an agreed number of points.

THE PLAY

The following description applies to the game when played by two players, although it will be appreciated that the rules will vary if more players are to play. Each of the players situates him or herself along an edge of the game board. The blocks are placed between the players off of the board marked face down and mixed. Each player chooses four blocks and places them face down in front of him. The players are allowed to look at their own blocks to determine which blocks they have in their possession, however each player should keep his blocks secret from the other player. One of the players is chosen to go first, either by lot or by agreement between the players. The player chosen to go first will be designated as player A for purposes of this description. The other player will be designated as player B. Player A chooses a block from his four which he wishes to play. He then places that block face up in the notch marked 1 on his edge of the board. Player B must then play one of his blocks. If possible, player B must play in the same color as the block lead by player A. If player B plays a block of the same color, which is a higher priority than the block played by player A, then player B wins the round and the right to play the first block of the next round. If player A's block is a higher priority than player B's, then player A wins the round and keeps the right to play the first block of the next round. Should player B not have a block which matches the color of the block played by player A, then player B can play any of his four blocks but will automatically lose the round to player A. A second round is played in the same manner with the winner of the first round playing the first block of the second round. Play proceeds through the second, third and to the fourth round. The winner of the forth round wins the match. The player winning the match scores a certain number of points for winning the match, for example, 10. In addition, the match winner is allowed to capture any vulnerable blocks which have been played. The vulnerable blocks are the lowest priority blocks in each suit which have, up to that point been exposed. For example, at the beginning of the game in the first match, all of the one or lowest priority blocks are vulnerable, therefore if any ones have been turned up, the match winner collects those and their associated points. Once the one or lowest priority block of any group has been collected or captured, then the two of that group becomes vulnerable. Once the two has been captured, then the three is vulnerable and so forth, up to the highest priority or Duke as the highest priority block is designated in the illustrated embodiment. The captured blocks are placed on their associated spaces face up in the center of the board and by looking at the center of the board, any player can determine at any time which blocks will be vulnerable in the current round. The players keep track of which blocks are collected by which player so that the score can be kept.

In the preferred embodiment, the winner of a match is awarded 10 points and each of the blocks from one through six are worth 10 points. The seventh priority blocks or the Lieutenants are worth 30 points and the highest priority blocks or Dukes are worth 50 points. The game can be played until one player reaches a predetermined number of points, for example 200.

If, during the play, no player has yet reached 200 points, and one of the Dukes is captured by a player or there are less than four blocks per player left to choose from, then all of the blocks are taken off the board and turned over and mixed as at the beginning of play and play continues until the first player reaches 200 points.

After each match, only the vulnerable blocks are captured and placed on the center of the board and the remaining blocks are turned back over and replaced in the pile between the players for the start of the next match.

Many variations can be played in scoring, however in the preferred embodiment, a running score is kept of each game for three consecutive games and the player with the highest overall score at the end of three games is declared the winner.

In keeping with the noble flavor of the game given by the designations Duke and Lieutenant on the highest and next highest priority cards, in the preferred embodiment, each of the games is termed a tournament. The player with the highest overall score after the completion of three tournaments is crowned King or Queen. The score cards are set up to reflect this noble terminology and if desired, a crown can be included with the game apparatus for the "King" or "Queen" to wear during the next game as a reward for winning. When the player wearing the crown loses a three tournament series, the crown goes to the winner of that series and the King or Queen has been dethroned. The optional crown is especially entertaining for child players.

In order to increase the difficulty of the game and to enhance its entertainment value, particularly for adult players, a variation can be played wherein the game apparatus further includes a point multiplier piece. The point multiplier piece of the preferred embodiment is a cube having numerals on each face thereof as shown in FIGS. 4 and 5. The illustrated cube has the numerals 2, 4, 8, 16, 32 and 64 thereupon to indicate that the point values are multiplied by 2, 4, 8, 16, 32 or 64, depending upon which face of the cube is exhibited. Again, in keeping with the terminology of the preferred embodiment, the optional maneuver of multiplying points is termed jousting. Jousting is accomplished in the following manner.

During play, the player having the lead, for example player A, if he feels that he can win a match or can bluff a player out of his play, may indicate such by pounding the table with his fist and declaring "Jousting!" He then places the multiplier cube on the table with the 2 face showing upwardly to show that the points for the match will be doubled. Player B may accept the challenge and play for double the eventual match score or if player B feels that the jousting player will certainly win the match, player B can decline the challenge, return any unplayed blocks face down to the center pile and take a loss of 10 points plus losing any vulnerable blocks which have been played up to that point to the challenging or "jousting" player. If player B feels that he can win the final fourth round himself, then rather than merely playing the match to its completion for double points, he may redouble by reaching out and turning the cube so that the 4 is facing upwardly, indicating that the points scored in the match will be quadrupled for the winner. This jousting and rejousting can continue until the multiple 64 is shown on the cube, the only limitation being that the same player cannot joust twice in a row, but must wait for an opposing player to joust in between. If jousting is included in the game, then the point value which is necessary to win a tournament must be accordingly raised, for example, the play can continue until one player reaches a thousand points in order to win the tournament.

Although one embodiment of a game which can be played according to the principles of the present invention has been illustrated and described, it will be seen by those of ordinary skill in the art and others that several variations can be made to the rules while remaining within the scope of the present invention as set forth in the claims. For example, the point multiplier cube can have any numerals on its face to indicate various point multiples, rather than the binary progression described above. Further, the blocks could have numerals on their faces rather than dots to indicate their priority and the highest priority cards could be designated by any suitable means rather than by Dukes and Lieutenants, as in the illustrated embodiment. Further, the blocks can be other than rectangular in shape, they could be square or round, or any other suitable configuration or cards could be used in place of blocks.

The embodiments of the invention in which an exclusive property or privilege is claimed are defined as follows:

1. A game apparatus comprising in combination a playing board and a set of blocks, the blocks being divided into first, second, third and fourth groups, each group containing an equal number of blocks, each block having upon it some marking that indicates to which group it belongs and also having upon it some indicia of its priority within its group, the board being a closed polygon, each side of the board having notches integrally formed therein along the perimeter of the polygon, said notches adapted to receive said blocks as they are played, the board further having a central portion divided into a plurality of spaces equal to the number of blocks in the set, each space carrying thereon indicia corresponding to a particular block and adapted to receive said corresponding block as play of the game progresses.

2. The apparatus of claim 1 wherein said blocks are in the shape of rectangular parallelepipeds and the group and the priority indicia are marked upon a first face of said rectangular parallelepiped.

3. The apparatus of claim 2 wherein there are 32 blocks in said set, 8 blocks being in each said group, six blocks of each group having dots thereon as said indices of priority, two blocks of each group having a marking other than dots thereon as indicia of priority.

4. The apparatus of claim 3 wherein said first face of said blocks of said first group are colored a first color, said first face of said blocks of said second group are colored a second color, said first face of said blocks of said third group are colored a third color and said first face of said blocks of said fourth group are colored a fourth color.

5. The apparatus of claim 4 wherein said first color is blue, said second color is red, said third color is green and said fourth color is yellow.

6. The apparatus of claim 1 wherein the number of sides of said board corresponds to the maximum number of players of the game.

7. The apparatus of claim 1 or 2 wherein said game board is in the shape of a rectangle, said notches being formed on each edge of said rectangle, there being four notches on each edge.

8. The apparatus of claim 1 further including a point multiplier piece, said point multiplier piece having indicia marked thereon to indicate multiples of point values to be gained by players during the playing of the game.

9. The apparatus of claim 8 wherein said point multiplier piece is a cube, each face of the cube having a numeral marked thereon, the numeral corresponding to the multiplier to be applied when calculating points.

* * * * *